US011473344B2

(12) United States Patent
Inan et al.

(10) Patent No.: US 11,473,344 B2
(45) Date of Patent: Oct. 18, 2022

(54) LOCKING SYSTEM FOR A MOTOR VEHICLE

(71) Applicant: Kiekert AG, Heiligenhaus (DE)

(72) Inventors: Ömer Inan, Dorsten (DE); Holger Schiffer, Meerbusch (DE); Michael Scholz, Essen (DE); Peter Szegeny, Engelskirchen (DE)

(73) Assignee: Kiekert AG, Heiligenhaus (DE)

( * ) Notice: Subject to any disclaimer, the term of this patent is extended or adjusted under 35 U.S.C. 154(b) by 280 days.

(21) Appl. No.: 16/844,538

(22) Filed: Apr. 9, 2020

(65) Prior Publication Data

US 2020/0325706 A1 Oct. 15, 2020

(30) Foreign Application Priority Data

Apr. 10, 2019 (DE) ..... 10 2019 109 488.7

(51) Int. Cl.
*E05B 81/06* (2014.01)
*E05B 81/14* (2014.01)
*E05B 81/40* (2014.01)

(52) U.S. Cl.
CPC ..... *E05B 81/06* (2013.01); *E05B 81/14* (2013.01); *E05B 81/40* (2013.01)

(58) Field of Classification Search
CPC ..... E05B 81/00; E05B 81/02; E05B 81/04; E05B 81/06; E05B 81/14; E05B 81/16; E05B 81/18; E05B 81/30; E05B 81/34; E05B 81/36; E05B 81/42; E05B 81/48; E05B 83/16; E05B 83/18; E05B 81/40; Y10T 292/1047; Y10T 292/1079; Y10T 292/1082; Y10T 292/306; Y10T 292/308; Y10S 292/23; Y10S 292/43
See application file for complete search history.

(56) References Cited

U.S. PATENT DOCUMENTS 4,518,181 A * 5/1985 Yamada ..... E05B 81/34 292/201
8,328,249 B2 12/2012 Corrales
2013/0015670 A1* 1/2013 Perkins ..... E05B 77/12 29/428

(Continued)

FOREIGN PATENT DOCUMENTS

CN 103003102 A * 3/2013 ..... E05B 81/06
DE 4125448 A1 * 2/1993 ..... E05B 81/25
DE 60200624 T2 6/2005

(Continued)

*Primary Examiner* — Christine M Mills
*Assistant Examiner* — Christopher F Callahan
(74) *Attorney, Agent, or Firm* — Renner, Otto, Boisselle & Sklar, LLP

(57) ABSTRACT

A locking system for a motor vehicle having a disc-shaped rotational member, a drive for rotating the rotational member around a rotational axis and a lever which can be moved by the rotational member. A ramp is provided on the disc-shaped rotational member and the locking system is set up in such a manner that the lever can be pivoted by the ramp when the rotational member is rotated by the drive. A particularly flexible adjustment to the available installation space can thus be achieved, at the same time as a particularly high degree of efficiency of the mechanical power transmission.

17 Claims, 2 Drawing Sheets

(56) References Cited

U.S. PATENT DOCUMENTS

| | | | | |
|---|---|---|---|---|
| 2018/0258671 | A1* | 9/2018 | Graute | E05B 77/36 |
| 2019/0153766 | A1* | 5/2019 | Knappe | E05B 81/44 |

FOREIGN PATENT DOCUMENTS

| | | | |
|---|---|---|---|
| DE | 112009001288 | T5 | 4/2011 |
| DE | 102016108565 | A1 | 11/2017 |
| DE | 102016108568 | A1 | 11/2017 |

* cited by examiner

LOCKING SYSTEM FOR A MOTOR VEHICLE

This application claims priority of German Patent Application No. 10 2019 109 488.7, filed Apr. 10, 2019, which is hereby incorporated herein by reference.

FIELD OF DISCLOSURE

The invention relates to a locking system for a motor vehicle with a disk-shaped rotational member, a drive for rotating the rotational member about a rotational axis and a lever which can be moved by the rotational member.

BACKGROUND OF DISCLOSURE

A locking system for a motor vehicle is generally used to prevent a door or hatch of a motor vehicle from opening unintentionally. For this purpose, a locking bolt of a door or hatch is usually accommodated by a catch of a locking mechanism and, when the locking mechanism is in the closed state, it is held by a pawl so that the door or hatch cannot open. For automated opening of the locking mechanism of the locking system, a drive can be provided which, via a worm gear, for example, can set in rotation a disk-shaped rotational member in the shape of a worm wheel, which in turn operates a lever with the aid of a cam. The lever can release the pawl from the catch by such an operation, so that the door or hatch can be opened again. The electrical energy required for automatic opening for the drive is usually provided by an energy source of the motor vehicle.

The available installation space for a locking system is often limited. The publication DE112009001288T5 discloses a lock arrangement for a motor vehicle in which a gear wheel with a lug and a pawl lever interacting with the lug each have axes of rotation offset by 90°. The interaction occurs laterally to the axis of rotation of the gear wheel.

Reference is also made to the publications DE102016108565A1 and DE102016108568 A1.

SUMMARY OF DISCLOSURE

The object of the invention is to provide a further developed locking system.

A locking system according to the present disclosure serves to solve the problem. Advantageous embodiments result from the disclosure.

A locking system for a motor vehicle with a disk-shaped rotational member, a drive for rotating the rotational member about a rotational axis and a lever that can be moved by the rotational member is used to solve the problem. A ramp is provided, i.e. present, on the disk-shaped rotational member. The locking system is set up in such a way that the lever can be pivoted through the ramp when the rotational member is rotated by the drive.

By providing a ramp on the disk-shaped rotation member for pivoting the lever, two advantages can be achieved simultaneously.

On the one hand, the rotational member and the lever allow a particularly flexible arrangement relative to each other, thus enabling the clamping system to fit compactly into a given installation space geometry. For example, a motor vehicle lock, as the locking system or as a part thereof, shall be housed in an L-shaped installation space geometry or a correspondingly L-shaped housing. Due to the ramp on the disk-shaped rotation member, a pivot axis of the lever can be arranged and mounted offset at an angle to the rotation axis of the rotation member. In this way, this arrangement can be placed around the corner, to a certain extent. This is of particular advantage if one leg of an L-shaped housing contains the locking mechanism and the other leg contains a connection to a source of electrical energy. The lever, which interacts in particular with the locking mechanism, and the drive, which is to be connected to a source of electrical energy, can then be installed in different legs of the L-shaped housing.

On the other hand, the provision of a ramp on the disk-shaped rotational member allows a pivoting and thus operating of the lever with particularly low mechanical losses from the interaction of the lever with the ramp. Thus, a very high degree of efficiency of the automated locking system can be achieved. Less electrical energy is then required for the operation of the locking system.

A locking system can be a motor vehicle lock for a door or hatch and/or part of a central locking facility or a closing aid for a motor vehicle. Preferably, a locking system for a motor vehicle comprises a locking mechanism which, in a closed state, can hold a door or a hatch in a closed position and, in an open state, allows the door or hatch to be opened from the closed position. The lever can be brought into contact with the ramp for interacting with the rotational member, i.e. it can touch the ramp directly and grind along the ramp when the rotational member is rotated. Thus, the lever can be moved by a rotational movement of the rotational member depending on the (geometric) course of the ramp in order to bring the locking mechanism into the open or closed state.

A disk-shaped rotational member can be, for example, a toothed wheel or a worm wheel. The use of a worm wheel as the disk-shaped rotational member enables a flexible and compact construction. A disk-shaped rotational member generally has a diameter that is greater than a thickness of the disk-shaped rotational member. The drive preferably comprises an electric motor and a drive shaft, which preferably drives the disk-shaped rotational member directly. In one configuration, the locking system and the drive are set up in such a way that the rotational member can be rotated in two rotational directions by the drive. This enables an automated resetting of the rotational member to a starting position or an automated latching and unlatching of a catch of a locking mechanism of the locking system. In one configuration, an automated rotating of the rotational member by the drive is only possible in one rotational direction. Resetting and/or latching of a catch is then affected by a force applied by the user and/or a mechanical energy storage such as a spring.

A lever can generally be pivoted about a pivot axis to transmit a force and/or movement. A pivoting of the lever through the ramp is basically caused by a contact, i.e. a direct touch, between the lever and the ramp. When the rotational member is rotated by the drive, the lever then grinds along the ramp. In the present locking system, the lever can, for example, be a pawl for locking the catch, a blocking lever for holding the pawl in a position that locks the catch, a release lever for releasing the pawl or the blocking lever or another locking member. A pawl as a lever enables a locking system with particularly few locking components. In combination with an automated drive in both rotational directions, a catch can be latched and unlatched particularly quickly and reliably. A release lever as a lever enables a particularly energy-efficient release of a locking mechanism, especially in combination with a blocking lever and/or automated driving of the rotational member in only one direction of rotation. A ramp is generally an inclined guide or operating surface. A ramp is not a chamfer on an edge, nor is it a manufacturing bevel or rounding of a corner. In particular, the ramp is formed by a lug which is, for example, integrally connected or manufactured with the rotational member. This reduces the number of parts. In one configuration, the ramp is formed by a separate component provided on the disk-shaped rotational member. This allows the use of different materials for the ramp and the rotational member and a reduction of manufacturing costs. The ramp or the separate component forming the ramp is then connected or coupled to the rotational member so that the ramp can be rotated together with the rotational member. If the ramp is provided by a separate component, preferably there is a motion-proof or at least torsion-proof connection with the rotational member. A ramp provided on the disk-shaped rotational member is located in the axial direction from the rotational member, i.e. in the direction of the rotational axis. The ramp is thus arranged at an upper side of the disk-shaped rotational member. The upper side refers to a surface of a disk base body on which the ramp is provided. The upper side does not refer to a collar surrounding the disk base body, which is provided, for example, for interacting with a drive shaft of the drive and has a larger axial expansion than the disk base body.

In an embodiment, the ramp runs obliquely to the rotational axis and/or falls off in a radial direction, referring to the rotational axis, towards the rotational member. The ramp therefore essentially has the shape of a lateral surface segment of a truncated cone-shaped structure. This allows the lever to be operated with a particularly high degree of efficiency, especially when the pivot axis of the lever is inclined to the rotational axis. In particular, the ramp is inclined in such a way that the lever is displaced away from the rotational member by guiding, sliding and/or grinding along the ramp. Preferably, the ramp hits obliquely on an upper side of the disk-shaped rotational member, which faces the ramp. In particular, the ramp is located entirely within the circumference of the disk-shaped rotational member on which the ramp is provided. In particular, the ramp is located entirely within the circumference of the disk-shaped rotational member on which the ramp is provided.

In one embodiment, the ramp runs curved in the circumferential direction around the rotational axis. A particularly targeted pivoting of the lever depending on the course of the ramp in the circumferential direction can thus be enabled by rotating the rotational member. In particular, the ramp runs over an angular range of at most 270°, preferably 235°, particularly preferably at most 205°, around the rotational axis. A particularly fast response time can be achieved in this way.

In one embodiment, an axial upper end of the ramp runs spirally around the rotational axis. By rotating the rotational member, the lever can thus be swiveled with particularly low frictional losses. An axial top end of the ramp refers to a longitudinal section along the rotational axis of the rotational member and means the point, which is axially farthest away from the upper side of the disk-shaped rotational member. In an embodiment in which the ramp meets the upper side of the disk-shaped rotational member, the axial expansion of the ramp corresponds exactly to the axial distance from the upper side of the disk-shaped rotational member to the axial upper end of the ramp. This axial distance and/or axial expansion changes depending on the angular position which, together with the rotational, spans the plane of the longitudinal section mentioned above. The axial upper end of the ramp thus increasingly moves away from the disk-shaped rotational member in the direction of the rotational axis relative to the lever with a fixed angular position when the rotational member is rotated by the drive preferably for pivoting the lever away from the rotational member.

In a configuration, the radial expansion of the ramp increases when viewed in the circumferential direction. This increases the reliability of the locking system.

In an embodiment, a radial distance from the rotational axis to the axial upper end of the ramp increases when viewed in the circumferential direction. This allows the lever to be pivoted particularly far, and this with a particularly high degree of efficiency.

In an embodiment, the ramp has a concave shape, especially when viewed in longitudinal section. A further optimized actuation vector can thus be obtained.

In one configuration, a lug with a cylindrical lateral surface is provided, i.e. the lateral surface extends curved around the rotational axis and parallel to the rotational axis. In particular, the lug has a greater axial expansion than the ramp. The axial upper end of the ramp can then lie on the cylindrical lateral surface. The ramp then includes an obtuse angle with the ramp when viewed in longitudinal section along the rotational axis. A particularly robust ramp can be obtained in this way.

In one embodiment, the lever can be pivoted through the ramp about a pivot axis that is axially spaced from the ramp. The axially spaced pivot axis enables a particularly effective pivoting of the lever.

In one embodiment, the pivot axis is inclined to the rotational axis by an angle difference. In particular, the angle difference is at least 45° and/or at most 135°, particularly preferably exactly 90°. A compact construction in a given installation space can thus be achieved with a low energy consumption of the drive. Minimal energy consumption is possible with an angle difference between 85° and 95°.

In one embodiment, the lever is displaced axially by the ramp when the rotational member is rotated by the drive. This enables a particularly reliable actuation of the lever. Axially displaced means in the direction of the rotational axis, in particular away from the disk-shaped rotational member.

In one embodiment, the lever is curved, L-shaped, hook-shaped or J-shaped. A particularly high degree of efficiency can thus be achieved during actuation by the ramp. In addition, a particularly compact locking system can be provided.

In one embodiment, the lever can reach over the disc-shaped rotational member from below the disc-shaped rotational member and contact the ramp. The lever can therefore encompass an annular collar on the outer circumference of the rotational member, which is in particular axially thicker than the disk base body of the rotational member. The lever can reach over the upper side of the rotational member to the radially inner ramp to contact the ramp. In particular, the lever is preferably pressed against the ramp by a spring in order to contact the ramp.

In one configuration, the free end of the lever is rounded. Preferably, the free end of the lever, viewed in cross-section through the pivot axis, has an almost semi-circular shape. This can reduce the frictional resistance.

In one embodiment, a free end of the lever relative to the rotational member slides or grinds spirally along the ramp when the rotational member is rotated by the drive. An actuation vector adapted to the movement of the lever and the free end with particularly low frictional losses can thus be obtained.

In one embodiment, a pitch angle of the ramp becomes progressively shallower as the rotational member is rotated by the drive, preferably in a rotational direction to pivoting the lever away from the rotational axis and/or to actuate the lever. A particularly high degree of efficiency can thus be achieved during the actuation despite the relative movement between the ramp and the lever.

In one embodiment, a radial distance between the rotational axis and a contact point between the free end of the lever and the ramp becomes progressively greater as the rotational member is rotated by the drive, preferably in a rotational direction to pivoting the lever away from the rotational axis and/or to actuate the lever. A particularly large pivot angle of the actuated lever can be realized in this way.

In one configuration, the ramp a pitch angle of at least 20° and/or at most 80°, in particular within a surface range over which the free end slides or grinds, the rotating member is rotated by the drive. Frictional losses can thus be reduced, especially in combination with a rounded free end of the lever, which contacts the ramp at the above-mentioned pitch angles.

In a configuration, the pitch angle of the ramp increases steadily in the circumferential direction along a path that slides or grinds the free end of the lever along the ramp as the rotational member rotates, especially from 20° to 80°. The pitch angle can thus be adapted to the relative movement and the change of orientation of the free end to the ramp in the range of the contact point to optimize the degree of efficiency, wherein the relative movement and the change of orientation is caused by the pivoting of the lever. The pitch is measured to a plane that runs perpendicular to the rotational axis. In particular, we measured the pitch to the top of the disk-shaped rotational member. Basically, the rotational axis is oriented perpendicular to the upper side of the rotational member.

In particular, in this document, the rotational direction refers to the direction of rotation around the rotational axis that results in a pivoting of the lever away from the rotational axis and/or actuation of the lever. The opposite direction of rotation is then the reverse rotational direction. An actuation of the lever preferably leads to the release of the locking mechanism, so that e.g. a door or hatch of a motor vehicle can be opened again. A rotation of the rotational member in the reverse rotational direction serves in a configuration for resetting the lever and/or the rotational member to a starting position. Alternatively, or in addition, a rotation of the rotational member in the reverse rotational direction can be used for latching a catch in order to bring a locking mechanism into a closed state in which, for example, a door or hatch of a motor vehicle is held securely in a closed position.

BRIEF DESCRIPTION OF DRAWINGS

In the following, exemplary embodiments of the invention are also explained in more detail by means of figures. Features of the exemplary embodiments and other subsequently described alternative or supplementary configurations can be combined individually or in a plurality. The scopes of protection described herein are not limited to the exemplary embodiments.

In which.

DETAILED DESCRIPTION

Figure 1:
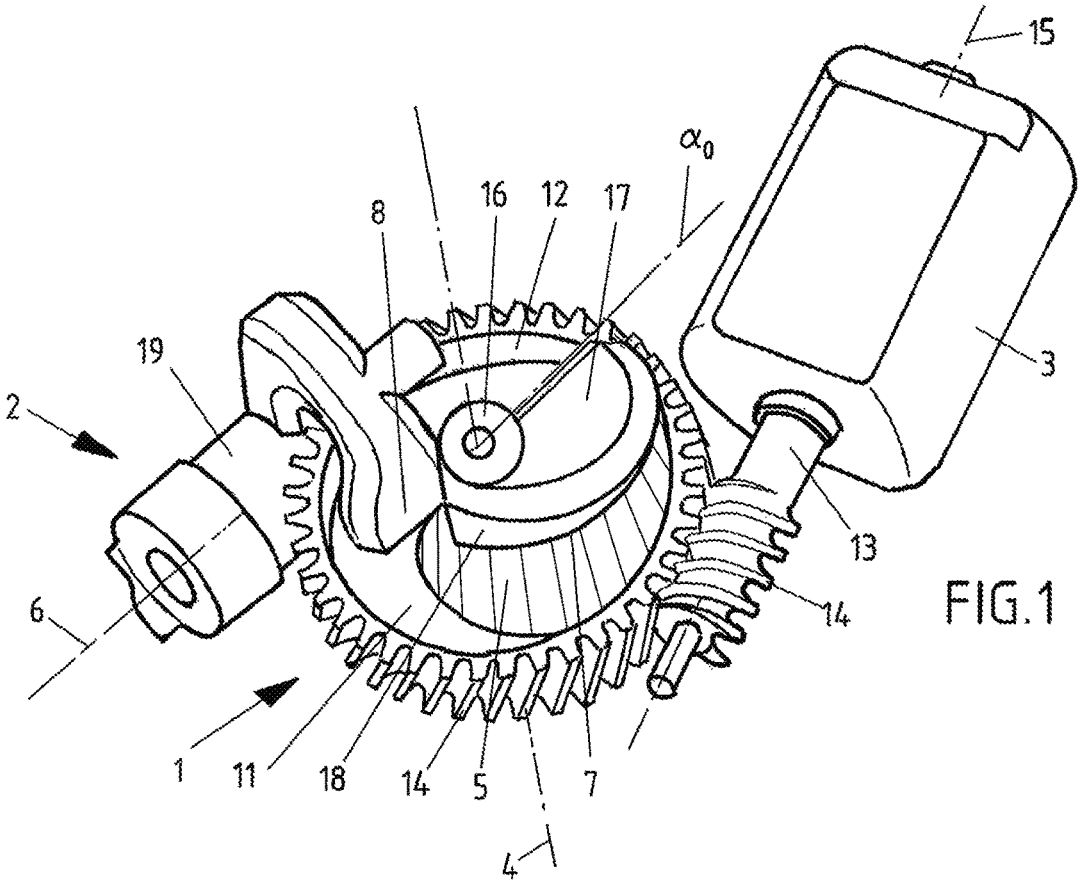
FIG. 1: Isometric representation of a drive for rotating a rotational member which is in a starting position $\alpha_0$ and can pivot a lever via a ramp on the rotational member.

FIG. 1 shows a disk-shaped rotational member 1, in particular in the shape of a worm wheel. The rotational member 1 has a disk base body 11 and a collar 12 surrounding the disk base body 11. The narrow, annular collar 12 has a greater expansion in the axial direction than the disk base body 11 and/or protrudes axially on the circumference of the disk base body 11. This projection preferably corresponds to at least twice the thickness of the disk base body 11. A drive 3, in particular an electric motor, is equipped with a drive axis 11 which can rotate about the axis of rotation 15, which is oriented tangentially to the circumference of the rotational member 1 and/or perpendicular to the rotational axis 4. Tooth profiles 14 corresponding to each other on the circumference of the drive axis 11 and on the outer, radial lateral surface of the collar interlock to transmit a rotation and a torque of the drive 3 to the rotational member 1, which is thereby made to rotate.

On the preferably flat surface of the disk base body 11 there is a ramp 5 present (hatched in FIG. 1), which extends from the surface inside the circular upper side in axial direction to form an oblique yielding on the rotational member 1. Also, a cylindrical sleeve 16, which forms a part of a bearing of the rotational member 1, and/or a lug 17 with a cylindrical lateral surface 18 is provided on this surface of the disk base body 11. In particular, the lug 17 and/or the ramp 5 extends around the sleeve 16. The ramp 5 preferably extends around the lug 17. In particular, the lug 17 projects beyond the ramp in the direction of the rotational axis 4. Preferably the ramp 5, the lug 17 and/or the sleeve 16 form optionally together with the rotational body a one-piece or at least one-piece structure, which is in particular in an edgeless conical shape. The structure has the overall form of a volcanic cone that is not rotationally symmetrical and becomes steeper in the circumferential direction. The ramp is based on the surface of the disk base body 11 and winds spirally around the lug 17, wherein the lug 17 and the ramp have a continuously increasing radius and radial expansion in the circumferential direction. An axial upper end 7 of ramp 5 has an increasing distance in the circumferential direction to the surface of the disk base body 11 and simultaneously to the rotational axis 4, whereby a spiral shape is created.

Lever 2 is pivotally mounted about a pivot axis 6, which is oriented perpendicularly to the rotational axis 4 and/or at least half the diameter of the rotational member from the rotational axis 1. The lever 2 has a tubular part 19 for mounting about the pivot axis 6. The pivot axis 6 is arranged below the rotational member 1. Perpendicular to the tubular part 19 and/or perpendicular to the pivot axis 6, the lever 2 extends in a hook shape, in particular J shape and can reach from below via the collar 12 to the lower surface of the disk base body 11 in order to contact the ramp 5 with the free end 8. Preferably, the free end 8 of lever 2 is thickened in the direction of the pivot axis 6 to enable particularly reliable actuation with particularly high degree of efficiency through ramp 5. In a starting position $\alpha_0$ of the rotational member 1, the free end 8 lies directly on or almost on the surface of the disk base body 11.

Figure 2A:
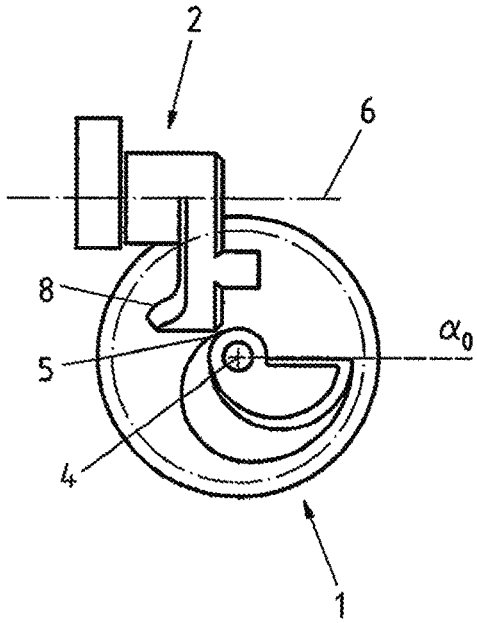
FIG. 2*a*: Schematic plan view of the arrangement of FIG. 1 in the starting position $\alpha_0$.
Figure 2B:
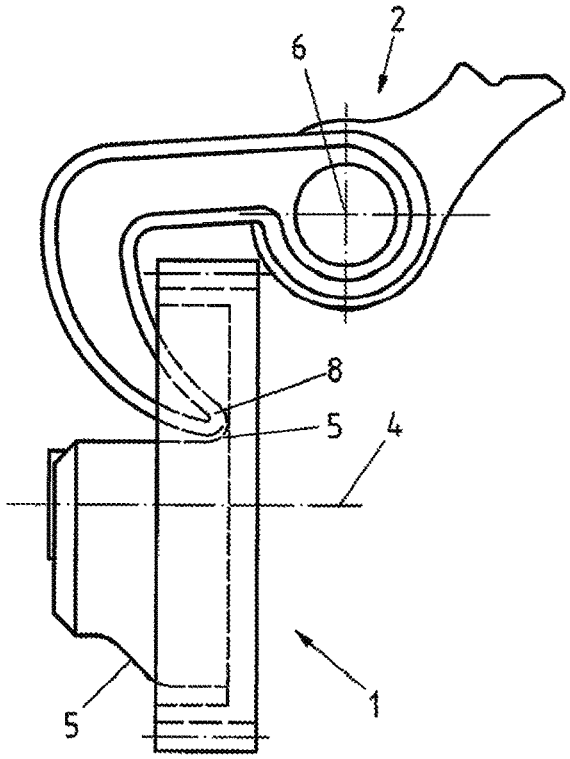
FIG. 2*b*: Lateral representation of the arrangement of FIG. 2*a;*

FIG. 2*a* shows the lever 2 and the rotational member 1 with the ramp 5 on it in plan view in the starting position $\alpha_0$ of rotational member 1. In one configuration, the surface of the disk base body 11 or the ramp 5 in the starting position $\alpha_0$ of the rotational member 1 is contacted with an end range of the free end 8 which is closest to the rotation axis 4 in the direction of the pivot axis 6. FIG. 2*b* shows the arrangement of the locking system of FIG. 2*a* in a side view. The free end 8 has the shape of a finger in cross-section and a rounded, preferably approximately semicircular end which contacts ramp 5 or is preferably only spaced from ramp 5 by a small air gap to protect the free end 8 from wear.

Figure 3A:
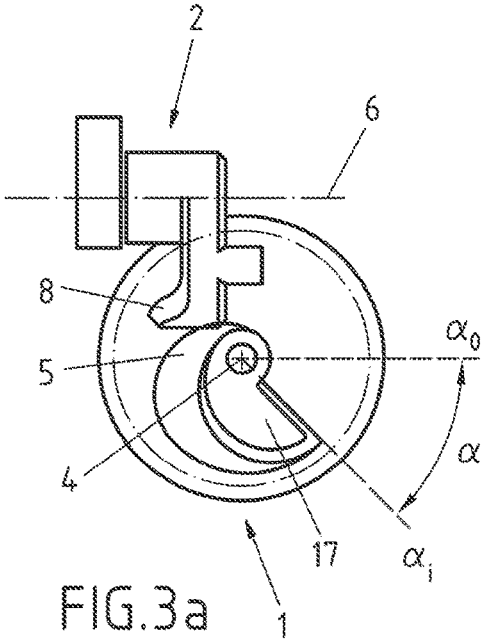
FIG. 3*a*: Schematic plan view of the arrangement of FIG. 2*a* during a rotation of the rotational member, shown in a first intermediate position $\alpha_i$.
Figure 3B:
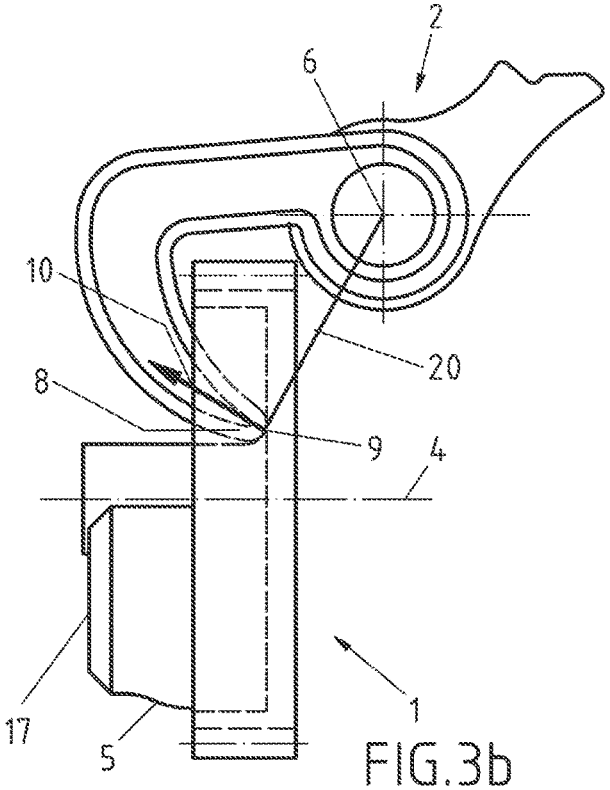
FIG. 3*b*: Lateral representation of the arrangement of FIG. 3*a;*

FIGS. 3*a* and 3*b* now show, in comparison with FIGS. 2*a* and 2*b*, a pivoting of lever 2 by the ramp 5, which is contacted at a contact point 9 by the free end 8 of lever 2 and pushes lever 2 from the starting position $\alpha_0$ to the shown intermediate position $\alpha_i$ as a result of the rotation. The power transmission takes place in the direction of an actuation vector 10. The actuation vector 10 extends approximately along the free end 8 of the lever 2, which indicates a power transmission with high degree of efficiency and little mechanical loss.

Figure 4A:
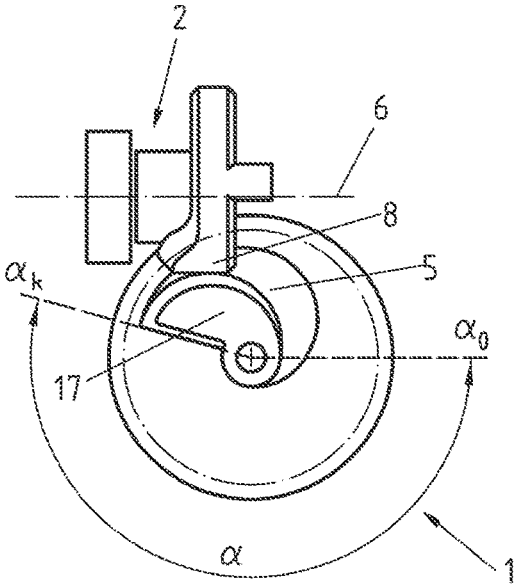
FIG. 4*a*: Schematic plan view of the arrangement of FIG. 3*a* during the rotation of the rotary member, shown in a second intermediate position $\alpha_k$.
Figure 4B:
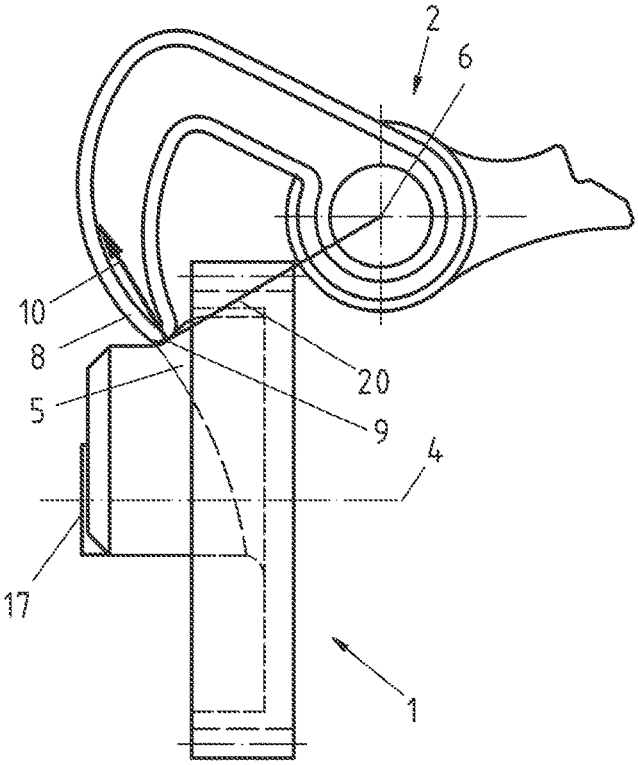
FIG. 4*b*: Lateral representation of the arrangement of FIG. 4*a.*

FIGS. 4*a* and 4*b* now show, in comparison to FIGS. 3*a* and 3*b*, a continuing of pivoting of lever 2 through ramp 5 by rotation from the intermediate position $\alpha_i$ to the intermediate position $\alpha_k$. The actuation vector 10, in the direction of which the power from ramp 5 acts on the free end 8 of lever 2, becomes steeper as the rotational member 1 is rotated by drive 3. The actuation vector 10 is perpendicular to a connection line 20 from the pivot axis 6 of a contact point 9 between lever 2 and ramp 5, where the free end 8 contacts the ramp 5.

By the rotation of the rotational member 1 in the rotational direction shown in the figures (clockwise) the lever 2 is actuated, which in turn interacts with a not shown locking mechanism. The contact points 9 together form a spiral shape around the rotational axis with increasing radius.

LIST OF REFERENCE SIGNS

1 Rotational member
2 Lever
3 Drive
4 Rotational axis
5 Ramp
6 Pivot axis
7 Axial upper end of the ramp
8 Free end of the lever
9 Contact point
10 Actuation vector
11 Disk base body
12 Collar
13 Drive axis
14 Tooth profile
15 Axis of rotation
16 Sleeve
17 Lug
18 Lateral surface of the lug
19 Tubular part of the lever
20 Connecting line
$\alpha_0$ Starting position
$\alpha_i$, $\alpha_k$ Intermediate positions

The invention claimed is:

1. A locking system for a motor vehicle, the locking system comprising:
- a rotational member that is disk-shaped;
- a drive for rotating the rotational member about a rotational axis; and
- a lever which is movable by the rotational member, wherein the rotational member includes a ramp and the locking system is arranged such that the lever is pivotable by the ramp when the rotational member is rotated by the drive,
- wherein a distance of an axial upper end of the ramp from a surface of the rotational member is a function of radial distance of the axial upper end of the ramp from a central axis of the rotational member such that the distance from the surface increases as the radial distance increases.

2. The locking system according to claim 1, wherein the ramp runs obliquely to the rotational axis and slopes in a radial direction towards the rotational member.

3. The locking system according to claim 1, wherein the ramp is curved in a circumferential direction about the rotational axis.

4. The locking system according to claim 3, wherein an axial upper end of the ramp extends spirally around the rotational axis.

5. The locking system according to claim 4, wherein the ramp has a concave shape.

6. The locking system according to claim 4, wherein the lever is pivotable by the ramp about a pivot axis axially spaced from the ramp and/or the pivot axis is inclined relative to the rotational axis by an angular difference.

7. The locking system according to claim 4, wherein the lever is L-shaped or J-shaped and/or can engage over the rotational member from below the rotational member and contact the ramp.

8. The locking system according to claim 4, wherein a free end of the lever slides spirally along the ramp relative to the rotational member when the rotational member is rotated by the drive.

9. The locking system according to claim 8, wherein a pitch angle of the ramp becomes continuously flatter and/or the radial distance becomes continuously larger as the rotational member is rotated by the drive.

10. The locking system according to claim 6, wherein the angular difference is between 45° and 135°.

11. The locking system according to claim 1, wherein the rotational member has a collar with a plurality of teeth that engages a corresponding tooth profile of the drive.

12. The locking system according to claim 1 further comprising a cylindrical sleeve that forms a bearing of the rotational member.

13. The locking system according to claim 12 further comprising a lug formed on a surface of the rotational member, wherein the lug and/or the ramp extends around the cylindrical sleeve.

14. The locking system according to claim 13, wherein the lug and the cylindrical sleeve are formed on the rotational member as one piece.

15. The locking system according to claim 1, wherein the rotational member has a non-rotationally symmetrical shape.

16. The locking system according to claim 1, wherein the lever has a tubular part mounted about a pivot axis.

17. The locking system according to claim 1, wherein an actuation vector is perpendicular to a connection line from a pivot axis to a contact point between the lever and the ramp.

* * * * *